United States Patent [19]

Dillon

[11] 3,961,625

[45] June 8, 1976

[54] PROMOTING CIRCULATION OF BLOOD

[76] Inventor: Richard S. Dillon, 150 Mill Creek Road, Ardmore, Pa. 19003

[22] Filed: June 9, 1975

[21] Appl. No.: 584,747

Related U.S. Application Data

[63] Continuation of Ser. No. 485,077, July 2, 1974, abandoned.

[52] U.S. Cl. ..... 128/40

[51] Int. Cl.[2] ..... A61H 1/00

[58] Field of Search ..... 128/24 R, 38–40, 128/64, 297, 299

[56] References Cited

UNITED STATES PATENTS

| | | | |
|---|---|---|---|
| 3,303,841 | 2/1967 | Dennis | 128/24 R |
| 3,403,673 | 10/1968 | MacLeod | 128/40 |
| 3,659,593 | 5/1972 | Vail | 128/64 |

OTHER PUBLICATIONS

Valtonen et al., American Journal of Physical Medicine, vol. 52, No. 2, pp. 59–64, (1973).

*Primary Examiner*—Lawrence W. Trapp
*Attorney, Agent, or Firm*—Donald R. Johnson

[57] ABSTRACT

This invention relates to a device for improving the circulation of blood and more particularly to a device for improving the circulation of blood to a patient's leg.

4 Claims, 2 Drawing Figures

PROMOTING CIRCULATION OF BLOOD

Figure 1:
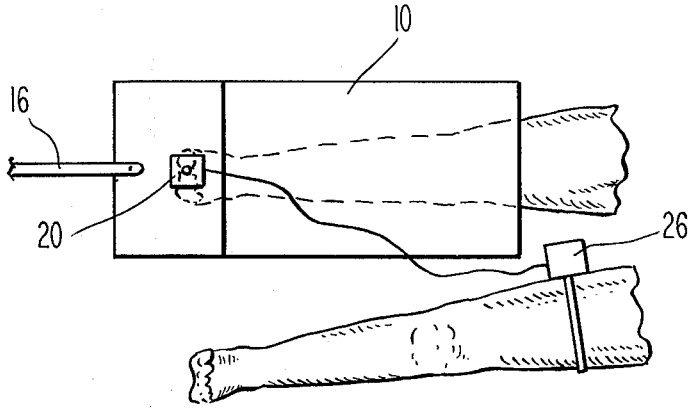

This is a continuation of application Ser. No. 485,077, filed July 2, 1974, now abandoned.

In the prior art, various devices have been proposed for applying pressure or vacuum to a patient's leg in order to affect blood circulation. However, the prior art devices have had certain drawbacks which are overcome by the present invention.

In Ferdinand J. Roensch, U.S. Pat. No. 2,230,068, issued Jan. 28, 1941, the production of intermittent venous hyperemia in a patient's leg by alternate subjection of the leg to a negative and a positive pressure through the application of suction on a boot encasing the leg, or the production of venous constriction by use of an inflatable cuff on the leg, is disclosed. The duration and frequency of the application of pressure according to that patent ranges from seconds to minutes.

Henry I. Poor, U.S. Pat. No. 2,533,504, issued Dec. 12, 1950, discloses apparatus for applying a peripherally extending band of constrictive pressure to a portion of a limb to be treated and translating the band of pressure along the limb by advancing the zone of pressure application until the end of the limb is reached, at which time all pressure is released and another band of pressure is applied and translated to repeat the cycle. Typically, the cycle requires three seconds to complete. The treatment is designed to force blood through the limb.

In Vasily Kravchenko, U.S. Pat. No. 3,465,748, issued Sept. 9, 1969, the production of arterial hyperemia in a patient's leg by subjecting it in a pressure chamber to a negative pressure of 400 to 680 mm. Hg, in order to increase the pressure differential between the oxygen in the blood and in the tissue cells to intensify gas exchange in the cells of hypoxic tissues, while preventing active hyperemia from converting into a passive one, is disclosed. In one embodiment, the negative pressure is maintained for 10 to 25 minutes, whereafter the chamber is pressurized at 900 to 1000 mm. Hg for 1 to 3 minutes and then depressurized for 5 to 7 minutes.

In Winfried Werding U.S. Pat. No. 3,536,063 issued Oct. 27, 1970, the improvement of venous return by subjecting the legs of a patient to pressure in compression boots having an inflatable double wall, the inner wall having variable thickness so that the pressure exerted by the boot on the leg is greater in the proximal part than in the distal part, thereby to obtain an effective therapeutic pressure of 120 to 200 mm. Hg in the distal part without obstructing the veins at the thigh level, is disclosed.

The above patents disclose treatments which are ineffective to produce increase in circulation to the leg to the extent desirable in some instances. The pressure condition that tends to promote circulation in one part of the arterial pulse curve tends to impede circulation in another part, with a net result that is unsatisfactory from the standpoint of achieving optimum improvement in circulation. For example, the treatment disclosed in the Poor patent, U.S. Pat. No. 2,533,504 above maintains an elevated pressure on a patient's leg during an entire arterial pulse cycle, and that pressure tends to prevent the arterial pulse, as it arrives at the leg, from entering the leg.

In Clarence Dennis, U.S. Pat. No. 3,303,841, issued Feb. 14, 1967, pressure is applied to the legs, hind quarters and pelvis of a patient to force blood into the aorta at a time in the pulse cycle when the aortic valve is closed, the pressure being relieved at the time in the cycle when the aortic valve is opened. The purpose of the compression is to establish satisfactory perfusion pressure in the aorta and arterial tree, while the relief of pressure permits contraction of the left ventricle of the heart against a lowered aortic pressue, thus reducing the work of the left ventricle.

Although the treatment disclosed in this patent may be beneficial in its reduction of the work of the left ventricle, it does not provide a desirable increase in the circulation of blood to the leg. The effect of the application of pressure is to force blood out of the leg, but the pressure also tends to block the flow of blood into the leg.

In an article by Erkki J. Valtonen et al in the American Journal of Physical Medicine, volume 52, number 2, pages 59 to 64, 1973, entitled "Effect of Timing and Duration of the Syncardial Pressure Pulses on Skin Temperature and Plethysmogram of the Legs", there is a disclosure of the application of pressure in pulses to a cuff around a patient's leg at mid-thigh, the pulses being timed to coincide with particular portions of the arterial pulse curve. In one set of experiments, based upon a method of M. Fuchs, in pulses of about 0.22 second duration were initiated on the descending limb of the arterial pulse curve. In another set of experiments based upon a Sonnen et al modification of the Fuchs method, impulses about 50 percent longer were initiated at the beginning of the pulse pressure period. Valtonen et al found the two methods to be essentially equivalent and to provide an increase in skin temperature and an increase in the amplitude of the arterial pulse wave. Valtonen et al concluded that the timing and duration of the syncardial pressure impulses may be matters of secondary importance.

Although these methods apparently provide an increased flow of blood to the leg, their effect on total circulation is not optimum and they are deficient in not substantially enhancing the return flow of blood from the leg to the heart.

For further discussion of the Fuchs principle of syncardial massage, and the Syncardon apparatus for such massage, reference is made to Robert L. Dilts' treatise, in Roe Wells' The Microcirculation in Clinical Medicine, Academic Press, pages 130 et seq. (1973). The pressure pulse is augmented by the compression of a cuff as the pulse passes under the cuff. ECG electrodes are placed on the arms and the pressure cuff on the thigh. Compression is indexed by the R wave of the ECG. The Syncardon employs electronic circuiting which uses self-contained ECG electrodes and permits the determination of the arrival time of the pulse beneath the cuff. The timing of the compression and the amount and duration of pressure are all accurately controlled.

According to the present invention, a treatment is provided which provides pressure pulses to a patient's leg at a time in the arterial pulse cycle to reinforce the pulse which forces blood into the leg, and which relieves the pressure at a time in the pulse cycle to enable the next pulse to enter the leg without undue obstruction.

The treatment according to the invention simultaneously provides a reinforcement of the movement of blood into the leg, and provides an enhancement of the return of blood from the leg to the heart, thereby increasing the overall circulation through the leg.

According to the invention, intermittent external pressure pulses are supplied to the leg, and timed in such fashion that the pressure pulse follows close upon the arrival of the arterial pulse at the upper end of the leg being treated, and reinforces the action of the arterial pulse in forcing blood into the leg. Between the external pressure pulses, the external pressure is removed or diminished, so that upon a succeeding arterial pulse, there is little or no external pressure on the leg, and the succeeding arterial pulse may enter the leg without undue obstruction resulting from external pressure.

The pressure pulses are supplied to the entire leg, so that the pressure acts not only in a portion of the arterial system of the leg, but to enhance the flow of blood in the entire arterial system, and to aid venous return from the leg to the heart. The pressure acts over a large portion of the affected area, enhancing the flow of blood from the area toward the heart and improving the circulation in the leg over that obtained by applying external pressure only in a relatively narrow band as in Valtonen etal supra.

Any suitable manner of providing external pressure pulses may be employed. In the previously mentioned Dennis patent, U.S. Pat. No. 3,303,841, pressure is applied to the parts of the body involved by transmission through a liquid medium, and this method can be used according to the present invention, although the timing of the relief of the pressure is critically different in the present invention from the timing in the Dennis patent. Such use of a liquid medium is not preferred, however, according to the present invention, since there is a pressure exerted on the body by the liquid medium itself, which is sometimes undesirable for the purposes of the present invention.

The net driving force delivering blood flow through a resting leg is normally the difference between the sum of gravity and the arterial blood pressure minus the sum of the venous blood pressure and vascular resistance. The latter is in part increased by tissue pressure pulsing on the arterial walls.

The present invention maximizes blood flow. The effect of gravity is utilized in one embodiment by keeping the patient's feet below the level of his trunk while the treatment according to the invention is applied. Venous pressure is reduced to zero and tissue pressure greatly reduced by intermittently squeezing the leg with compressed gas, which also adds to the arterial pulse pressure, increasing blood flow to the leg.

Figure 2:
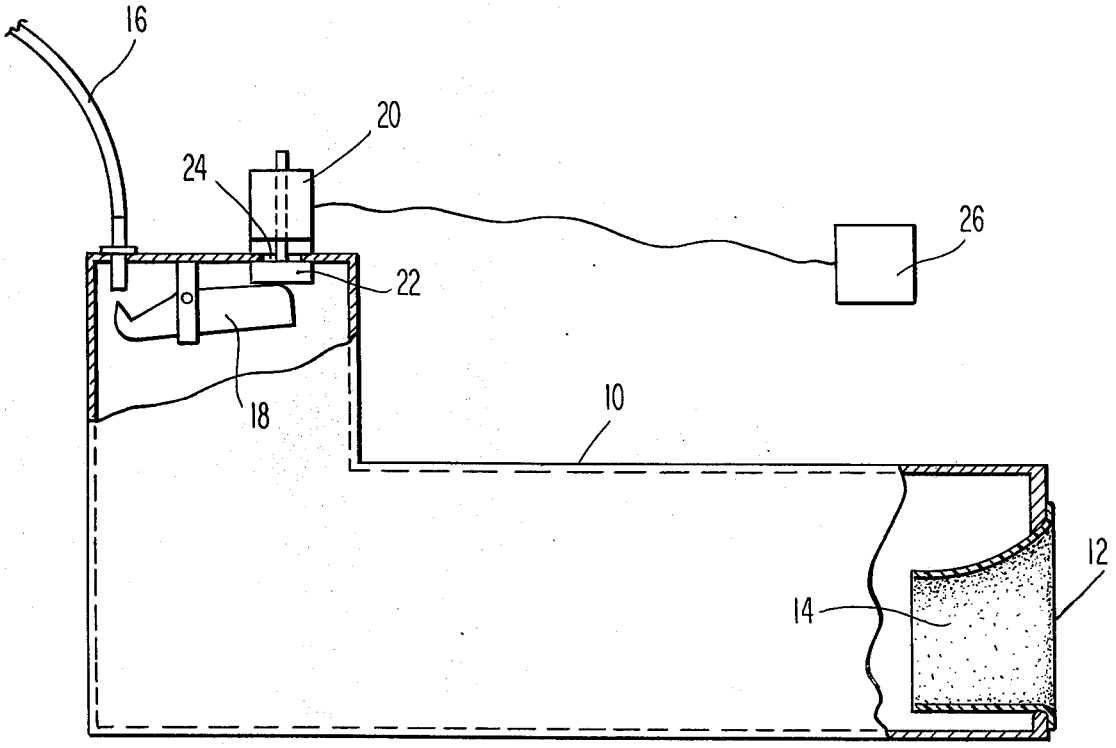

Referring to the drawings, FIG. 1 is a plan view, and FIG. 2 an elevational view of apparatus according to the invention. An enclosure 10 for a patient's leg has an opening 12 for insertion of the leg. A rubber cuff 14 secured to the enclosure provides a seal to enable obtaining the desired elevated pressure within the enclosure. A gas inlet line 16 is connected to a source of compressed gas and communicates with the interior of the enclosure. A rocker bar 18 is adapted to close the end of the line 16 when solenoid 20 is depressed. Depression of solenoid 20 also moves valve element 22 away from opening 24 in the wall of the enclosure. Pulse sensor 26 is attached to the patient's other leg, and is electrically connected to solenoid 20.

In operation, pulse sensor 26 senses the pulse entering the one leg and generates a signal which, amplified by conventional means not shown and acting through a conventional switch not shown, depresses the solenoid 20 thus simultaneously causing rocker bar 18 to close the end of line 16, terminating the communication between the compressed gas in line 16 and the interior of enclosure 10, and opening valve 22 to permit the compressed gas in enclosure 10 to flow through opening 24.

Current flows through solenoid 20 for a fraction of a second, e.g. about 0.1 second, as a result of generation of the signal by pulse sensor 26. When the flow of current ceases, the solenoid, which is biased upwardly by means not shown, returns to its upper positions, thus simultaneously moving rocker bar 18 away from the end of line 16 and closing valve 22. The flow of compressed gas into enclosure 10 resumes, and the pressure rapidly builds up, valve 22 now being closed, to a pressure of about 20 mm. of Hg gauge, for examaple. This pressure, following close upon the entry of blood into the leg impelled by the arterial pulse, supplements the arterial pulse in forcing blood into the leg, and improves the circulation of blood through the leg.

When the next pulse enters the legs, the pulse sensor again activates the solenoid and almost instantaneously reduces the pressure in enclosure 10 to essentially atmospheric pressure by shutting off the compressed gas supply and opening the escape valve 22. This permits the blood to flow into the leg without substantial impeding by external pressure. The cycle as described is again repeated.

Thus, a cyclic operation is established whereby one leg is subjected to elevated pressure to improve movement of blood through the leg, the pressure being periodically interrupted at the point in the arterial pulse cycle at which blood is entering the leg, so that such entry is not impeded by external pressure.

The previously described use of a pulse sensor on the other leg is a preferred means for timing the relief of the external pressure according to the invention. However, other means can be employed, such as an electrocardiogram apparatus. The use of the pulse sensor on the other leg has the advantage that the signal is being generated at the precise time that the pressure is to be relieved, so that no delay factor is involved, and reliably accurate timing is achieved.

The sudden relief of pressure according to the invention is timed to coincide, or nearly coincide, with the arrival of the arterial pulse at the entry to the part of the body involved. Preferably, the timing coincides as exactly as possible. Thus, a pulse sensor may be located somewhat upstream from the entry to the part involved, to compensate for the delay in actuation of the pressure relief mechanism. However, the apparatus previously disclosed is sufficiently quick-acting that the delay is not significant, and the benefits of the invention may be obtained without compensating for such delay.

Apparatus similar to the Syncardon apparatus, but with the Syncardon cuff replaced by means whereby pressure can be uniformly applied to substantially the entire leg, for example, can be employed according to the invention.

Although the invention has been described in relation to application of pressure to a leg, it is to be understood that the invention may be used to improve circulation through various parts of the body. The part or parts of the body to be treated are placed in an enclosure which is pressurized with compressed gas, and means are provided for sudden relief of the pressure timed to coincide with, or very nearly coincide with, the arrival of the arterial pulse at the entry to the part or parts of the body involved.

The invention claimed is:

1. Method of promoting circulation of blood through a leg which comprises: subjecting substantially the entire portion of the leg from thigh to foot to external pressure of compressed gas on the leg to improve circulation of blood through the arteries and veins in said portion; and periodically suddenly reducing the external pressure upon the arrival of the arterial pulse at said portion of the leg.

2. Apparatus for promoting circulation of blood through a leg which comprises: an enclosure for substantially the entire portion of the leg from thigh to foot; means for supplying compressed gas to said enclosure for pressure on the leg; means for interrupting the supply of compressed gas to said enclosure; means for venting gas from said enclosure; and means, responsive to action of the heart, for suddenly actuating said means for interrupting and said means for venting upon the arrival of the arterial pulse at the entry into said portion of the leg.

3. Method of promoting circulation of blood through a leg which comprises: subjecting substantially the entire portion of the leg from thigh to foot to external pressure following the entry of the arterial pulse into said portion of the leg, to improve circulation of blood through the arteries and veins in said portion; and periodically suddenly reducing the external pressure upon the arrival of the arterial pulse at said portion of the leg.

4. Apparatus for promoting circulation of blood through a leg which comprises: an enclosure for substantially the entire portion of the leg from thigh to foot; means for supplying compressed gas to said enclosure; means for interrupting the supply of compressed gas to said enclosure; means for venting gas from said enclosure; means for actuating said means for supplying compressed gas to said enclosure following the entry of the arterial pulse into said portion of the leg; and means responsive to action of the heart, for suddenly actuating said means for interrupting said means for venting upon the arrival of the arterial pulse at the entry into said portion of the leg.

* * * * *